US009304468B2

(12) United States Patent
Miyazaki

(10) Patent No.: US 9,304,468 B2
(45) Date of Patent: Apr. 5, 2016

(54) IMAGE FORMING APPARATUS, IMAGE FORMING SYSTEM, AND IMAGE FORMATION CONTROL METHOD

(71) Applicant: KONICA MINOLTA, INC., Chiyoda-ku, Tokyo (JP)

(72) Inventor: Ken Miyazaki, Sagamihara (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/550,908

(22) Filed: Nov. 21, 2014

(65) Prior Publication Data

US 2015/0153697 A1 Jun. 4, 2015

(30) Foreign Application Priority Data

Nov. 29, 2013 (JP) ..... 2013-248247

(51) Int. Cl.
*G03G 15/22* (2006.01)
*G03G 15/00* (2006.01)

(52) U.S. Cl.
CPC ..... *G03G 15/556* (2013.01); *G03G 15/5062* (2013.01); *G03G 2215/00738* (2013.01); *G03G 2215/00751* (2013.01); *G03G 2215/00755* (2013.01)

(58) Field of Classification Search
CPC ..... G03G 15/5062; G03G 221/00067
See application file for complete search history.

(56) References Cited

U.S. PATENT DOCUMENTS 7,097,270 B2 * 8/2006 Yamazaki ..... 347/19
7,619,792 B2 11/2009 Itagaki et al.
7,903,287 B2 3/2011 Itagaki et al.
8,368,903 B2 * 2/2013 Takaki ..... 358/1.12
2012/0106994 A1 * 5/2012 Ishida et al. ..... 399/45
2013/0216244 A1 * 8/2013 Miyazaki ..... 399/15

FOREIGN PATENT DOCUMENTS

JP 2007272112 A 10/2007
JP 2009139561 A 6/2009
JP 2012189797 A 10/2012
JP 2013167809 A 8/2013

OTHER PUBLICATIONS

Japanese Office Action (and English translation thereof) dated Dec. 1, 2015, issued in counterpart Japanese Application No. 2013-248247.

* cited by examiner

*Primary Examiner* — Clayton E LaBalle
*Assistant Examiner* — Leon W Rhodes, Jr.
(74) *Attorney, Agent, or Firm* — Holtz, Holtz & Volek PC

(57) ABSTRACT

A memory section 1013, an image forming section 150, a control section 101, and a density detecting section 220 to detect a density of an image are disposed. when performing density adjustment by forming a density patch on a sheet with the image forming section, receiving the density detection result of the density patch, and adjusting the image forming section based on the density detection result such that a highest density with the toner coincides with a target density, a target density-compliant sheet profile which is a sheet profile including sheet setting for a sheet used at the time of determining the target density and the target density are memorized in the memory section; and the image forming section is adjusted based on the target density-compliant sheet profile and the target density such that the highest density coincides with the target density.

17 Claims, 17 Drawing Sheets

IMAGE FORMING APPARATUS, IMAGE FORMING SYSTEM, AND IMAGE FORMATION CONTROL METHOD

The present application claims the priority based on Japanese Patent Application No. 2013-248247 filed on Nov. 29, 2013 in accordance with the provision of U.S. Patent Law Article 119.

BACKGROUND OF THE INVENTION

1. Field of the Invention

The present invention relates to appropriate control in highest density adjustment in an image forming apparatus, an image forming system, and an image formation control method.

2. Description of Related Art

Conventionally, in electrophotographic image forming apparatuses, the following matter has been known. That is, even if the weight of toner per unit area on a sheet (hereafter, referred to as a toner adhesion amount) is the same, if the kind of a sheet is different, the density (optical density of a finally-output image becomes different due to its influence.

For example, in a coated paper sheet, since the sheet surface is made smooth, the image density becomes high (dense), but in a coarse paper sheet, the image density tends to become low (thin). This is because the image density is greatly influenced by the degree of penetration of toner to a paper sheet at a fixing process in an image forming apparatus.

For this reason, in an image forming apparatus designed or adjusted such that the print density standard is determined based on a sheet which easily exhibits an image density, such as a coated paper sheet, if an image is formed on a coarse paper sheet, a problem arises such that the image density becomes low.

Then, in the case where such a decrease of density exceeds a range capable of being solved by a density adjusting function provided to an ordinary image forming apparatus, a technique has been proposed to avoid such a problem by changing a toner adhesion amount in a range of a given level.

Further, different from the relative density adjustment in response to a difference in the kind of a sheet, there has been exists an absolute adjustment to make the highest density of an image forming apparatus become a reference value by using a predetermined reference sheet.

Some techniques with regard to adjustment of density in the electrophotographic image forming apparatuses have been disclosed in Japanese Unexamined Patent Publication Nos. 2012-189797 and 2009-139561.

Japanese Unexamined Patent Publication No. 2012-189797 has proposed a technique enabling to set a different toner adhesion amount for the same kind of a sheet so as to realize different color reproduction in response to a user's request. Further, Japanese Unexamined Patent Publication No. 2009-139561 has proposed a technique, at the time of using regular paper, to perform the highest density adjustment prepared for regular paper, and, at the time of using coated paper, to perform the highest density adjustment prepared for coated paper.

However, none of the above-mentioned patent publications proposes the absolute adjustment to make the highest density of an image forming apparatus become a reference value by using a predetermined reference sheet. In order to adjust the highest density in an image forming apparatus, a technique may be considered to perform adjustment in two stages separately into a highest density initial adjustment and a highest density automatic adjustment.

For example, in order to adjust the highest density in an image forming apparatus, at the initial time such as at the time of installing the image forming apparatus, the peculiar characteristic of a process unit is corrected. For this reason, a customer engineer determines a highest density reference as highest density initial adjustment. Subsequently, at an arbitrary time after the highest density initial adjustment, a user detects the density of an image density patch formed on a sheet by an image forming section with a density sensor, adjusts an image forming section so as to make the highest density coincide with a predetermined target density, and suppresses a characteristic change accompanying environmental fluctuation or the aged deterioration of a process unit.

In the highest density initial adjustment by a customer engineer and the highest density adjustment by a user, a calibration chart is formed on a sheet by image formation, a highest density portion (solid patch) on the calibration chart is detected by a density sensor, and each section of the image forming apparatus is adjusted until it is confirmed that a detection result is the desired density (toner adhesion amount). In the image forming section, an electrostatically charging voltage or a developing bias voltage is changed so as to increase or decrease a toner adhesion amount.

Incidentally, in the adjustment of the highest density, in order to administrate the highest density appropriately, a user is required in the highest density adjustment to use the same sheet and the same sheet setting used by the customer engineer at the time of determining a target density in the highest density initial adjustment.

Accordingly, when a user performs the highest density automatic adjustment, it is necessary to keep in mind the sheet and its sheet setting used by a customer engineer for the highest density initial adjustment. Further, at the time of the highest density adjustment by a user, it is necessary to perform a work to reproduce the sheet setting for the sheet used by a customer engineer for the highest density initial adjustment as a sheet profile. As a result, a problem arises in that it takes time to perform the work of the reproducing.

Further, if a mistake is made for the setting in the work of the reproducing, a problem arises in that it becomes impossible to adjust a desired highest density appropriately in an image forming apparatus. As described in the above, even if any kind of techniques are used, it has been quite difficult to perform adjustment so as to make the highest density of an image forming apparatus to the desired reference value.

SUMMARY OF THE INVENTION

The present invention has been achieved in view of the above problems, and an object of the present invention is to realize an image forming apparatus, an image forming system, and an image formation control method, in which a desired highest density can be adjusted appropriately without performing troublesome setting operations at the time of adjusting the highest density of an image forming apparatus.

(1) An image forming apparatus to which one aspect of the present invention is reflected, includes:

a memory section configured to memorize various kinds of information;

an image forming section configured to form an image with toner on a sheet; and a control section configured to control formation of an image by the image forming section;

wherein when the control section performs density adjustment by forming a density patch on a sheet with the image forming section, receiving the density detection result of the density patch, and adjusting the image forming section based on the density detection result such that a highest density with the toner coincides with a target density, the control section memorizes a target density-compliant sheet profile (a sheet profile corresponding to a target density) which is a sheet profile including sheet setting for a sheet used at the time of determining the target density and the target density in the memory section; and adjusts the image forming section based on the target density-compliant sheet profile and the target density such that the highest density coincides with the target density.

(2) In the above (1), the control section can perform two kinds of density adjustment of a highest density initial adjustment and a highest density automatic adjustment. Here, in the above highest density initial adjustment, the target density is determined to make the highest density coincide with the target density. Further, in the highest density automatic adjustment, at an arbitrary time after having determined the target density in the highest density initial adjustment, a highest density of the density patch is detected by the density detecting section, and the image forming section is adjusted so as to make the highest density coincide with the target density.

(3) In the above (1) or (2), the sheet setting in the target density-compliant sheet profile includes at least a kind of a sheet, a basis weight of the sheet, an offset value of a toner adhesion amount, and information on process adjustment.

(4) In the above (1) to (3), the target density-compliant sheet profile is memorized in a predetermined memory position in the memory section, and at the time of adjusting the highest density, the target density is read out from the memory section, and the target density-compliant sheet profile is read out.

(5) In the above (1) to (4), a sheet feeding section provided with a try for accommodating sheets is disposed, the sheet profile can be correlated with the tray in response to the setting of the tray, and at the time of adjusting the highest density, the target density-compliant sheet profile is used without being correlated with the tray.

DETAILED DESCRIPTION OF THE PREFERRED EMBODIMENT

Hereafter, description is given in detail to a specific example of a mode (hereafter, referred to an embodiment) for implementing the present invention with reference to drawings.

<Constitution of an Image Forming Apparatus>

Figure 1:
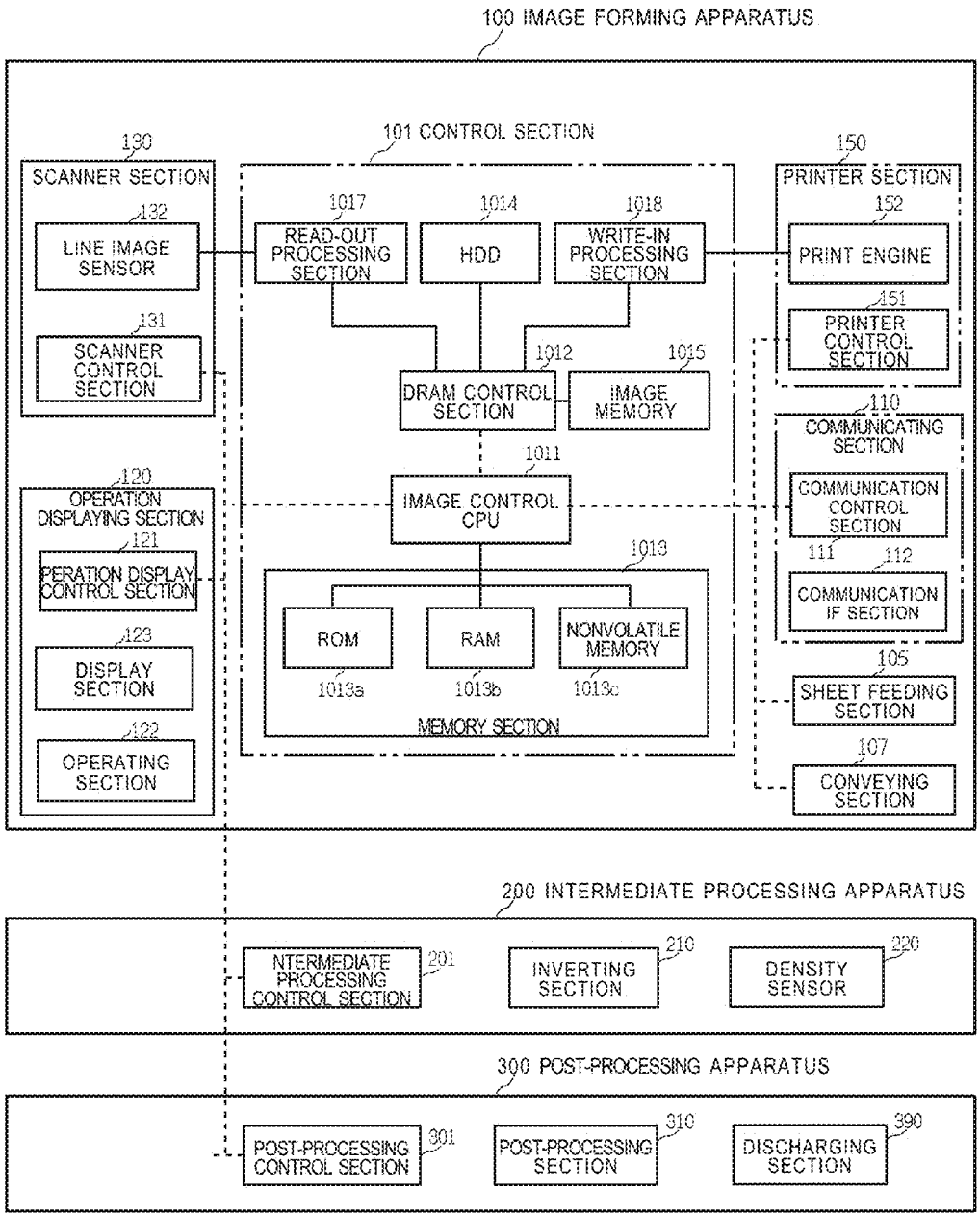
FIG. 1 is a block diagram showing the constitution of an image forming system of an embodiment.
Figure 2:
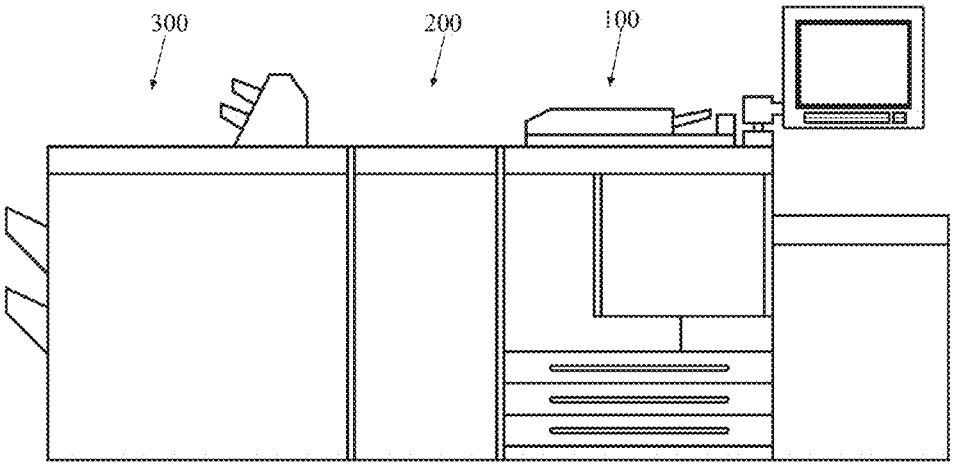
FIG. 2 is a constitutional illustration showing the constitution of the image forming system of the embodiment.

FIG. 1 shows a system constitution of an image forming system including an image forming apparatus 100 according to the first embodiment of the present invention. FIG. 2 shows an outer appearance of the constitution of the image forming system including the image forming apparatus 100.

The image forming apparatus 100 is enabled to receive a printing job through networks, such as LAN (Local Area Network), from a not-shown personal computer (PC).

Further, the image forming apparatus 100 is constituted as a so-called digital color composite machine equipped with a copying function which reads a document optically and forms a duplicate image of the document on a recording sheet as well as a print outputting function at a printer section 150 mentioned later.

The image forming apparatus 100 includes a control section 101, a sheet feeding section 105, a conveying section 107, a communicating section 110, an operation displaying section 120, a scanner section 130, and a printer section 150. At the latter stage of the image forming apparatus 100, an intermediate apparatus 200 acting as a relay unit and a post-processing apparatus 300 are connected to.

The control section 101 is configured to control the image forming system as a whole control section. The sheet feeding section 105 is configured to feed out sheets accommodated in a tray. The conveying section 107 is configured to convey a sheet fed out from the tray in synchronization with the timing of image formation. The communicating section 110 is configured to communicate with external devices. The operation displaying section 120 is configured to receive operations from operators, such as a customer engineer and a user and to display various kinds of information items. The scanner section 130 is configured to read documents. The printer section 150 is configured to form an image on a sheet and to output the sheet.

The communicating section 110 includes a communication control section 111 and a communication IF section 112. The communication control section 111 is configured to control communication functions. The communication IF section 112 is configured to communicate with external devices through a not-shown network. Examples of the external devices include PC and a density detector.

The operation displaying section 120 includes a function to display various setting screens, an operation screen, a job selecting screen, a job editing display, an output reservation job list screen, and the like; a function to display various kinds of guidance information, notices, warnings, and the like for an operator; a function to receive various kinds of settings, selecting operations, and editing operations from an operator; and a function to receive output instructions (a start instruction of image formation).

The operation displaying section 120 is constituted to include an operation display control section 121, an operating section 122, and a display section 123. The operation display control section 121 is configured to control the display section 123 and the operating section 122. The operating section 122 is constituted by a touch switch disposed on a screen of the display section 123, and other switches. The display section 123 is constituted by a liquid crystal display and the like.

The scanner section 130 includes a scanner control section 131 and a line image sensor 132. In addition, the scanner section 130 includes a document conveying function, a document image processing circuit, and the like which are not illustrated. The scanner control section 131 is configured to control a document reading function in the scanner section 130. A line image sensor 132 is adapted to read a document and to create image data.

The printer section 150 serves as an image forming section to form an image, and includes a printer control section 151 and a print engine 152. The printer control section 151 controls a printer function in the printer section 150. The print engine 152 is configured to form an image on a sheet by using a toner with an electrophotographic method. In concrete terms, the print engine 152 is adapted to expose an electrostatically-charged photoreceptor (image bearing member) to light beams corresponding to image data so as to form an electrostatic latent image by changing an electric potential on the surface of the photoreceptor, to develop the latent image with toner so as to form a toner image, and to transfer the toner image onto a sheet. At the time of the above image formation, process conditions, such as an electrostatically-charged potential, a developing bias electric potential, and a transfer potential, are adjusted, whereby the density (optical density) of an image on a sheet can be changed.

The control section 101 is configured to control the operations of the image forming apparatus 100 generally. Here the control section 101 is constituted to include an image control CPU 1011, a DRAM (Dynamic Random Access Memory) control section 1012, a memory section 1013 to memorize various data, a hard disk device (HDD) 1014, an image memory 1015, a read-out processing section 1017, a write-in processing section 1018, and the like.

Here, the image control CPU 1011 is configured to control the whole operations of the image forming apparatus 100 and the image forming system. The memory section 1013 is constituted to include ROM 1013*a*, RAM 1013*b*, a nonvolatile memory 1013*c*, and the like. In the ROM 1013*a*, programs and various fixed data are memorized, and the image control CPU 1011 is adapted to operate in accordance with the programs stored in the ROM 1013*a*. The RAM 1013*b* is used as a work memory to store various kinds of data temporarily at the time that the image control CPU 1011 executes a program. The nonvolatile memory 1013*c* is adapted to memorize user data, system data, and various settings, which are to be memorized after power OFF. A later-mentioned sheet profile is created and memorized in the nonvolatile memory 1013*c*.

The DRAM control section 1012 is configured to perform timing control for reading, writing, and refreshing for the image memory 1015 composed of a dynamic RAM, and to perform timing control at the time that image data are compressed and stored in the image memory 1015 and that compressed image data are read out from the image memory 1015 and extended.

The HDD 1014 is adapted to accumulate print data received from external devices via the network and intermediate data created in the course of processing at an a RIP process. The read-out processing section 1017 is adapted to apply expanding processing, mirror image processing, error diffusion processing, and the like to image data output from the scanner section 130.

The write-in processing section 1018 is adapted to output signals to drive the printer section 150 at the timing in response to the action of the printer section 150 in accordance with image data which are read out from the image memory 1015 and extended.

Here, each of the image control CPU 1011, the communication control section 111, the operation display control section 121, the scanner control section 131, and the printer control section 151 is constituted by a circuit which includes a CPU (Central Processing Unit), a ROM (Read Only Memory), and a RAM (Random Access Memory) as a main portion, and is adapted to perform various kinds of control in accordance with the programs stored in the ROM.

The mechanical constitution of the printer section 150 is a constitution known as an image forming apparatus of an electrophotographying system. For this reason, detailed description is omitted. The print engine 152 included in the printer section 150 is configured to form an image on a sheet with monochromatic toner for a monochrome image and to form an image on a sheet with multiple kinds of toners different in color for a color image. For example, in the case of forming a monochrome image, toner of black (K) is mainly used. Further, in the case of forming a color image, toners of yellow (Y), Magenta (M), cyanogen (C), and black (K) are mainly used.

The intermediate processing apparatus 200 is constituted to include an intermediate processing control section 201 to control each section of the intermediate processing apparatus 200, an inverting section 210 to invert a sheet in the course of conveyance, and a density sensor 220 serving as a density detecting section to read the toner density of an image in the course of conveyance. The intermediate processing control section 201 is adapted to communicate with the control section 101, thereby controlling the actions of the intermediate processing apparatus 200 under the control of the control section 101.

Figure 3:
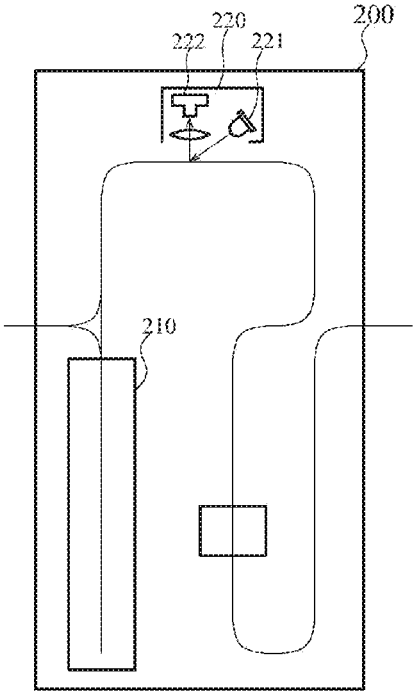
FIG. 3 is a constitutional illustration showing the constitution of a main portion of the image forming system of the embodiment.

Further, as shown in FIG. 3, the density sensor 220 is adapted to irradiate a sheet in the course of conveyance with light with a predetermined wavelength from a light emitting element 221, to receive the reflected light with a light receiving element 222, and to detect a toner density on the sheet. Here, in the case of dealing with a color image, each of the light emitting device 221 and the light receiving element 222 is constituted to handle light beams with respective different wavelengths corresponding to multiple kinds of toners different in color.

The post-processing apparatus 300 is an apparatus provided with various kinds of post-processing functions, such as creasing a recording sheet, binding multiple stacked recording sheet with a staple, and making a hole with a punching device. Here, the post-processing apparatus 300 is constituted to include a post-processing control section 301 to control each section of the post-processing apparatus 300, a post-processing section 310 to perform various kinds of post-processing items, and a discharging section 390 to discharge a sheet. The post-processing control section 301 is adapted to communicate with the control section 101, thereby controlling the actions of the post-processing apparatus 300 under the control of the control section 101.

<Memory Content of a Nonvolatile Memory>

Here, description is given to a sheet profile, a D-MAX adjustment value, etc., which are memorized in the nonvolatile memory 1013*c*.

In the image forming apparatus 100, setting information about sheets used in image formation is registered as a sheet profile 1013*p* on a condition of being correlated with a tray of the sheet feeding section 105, and memorized in the nonvolatile memory 1013*c*.

Figure 4:
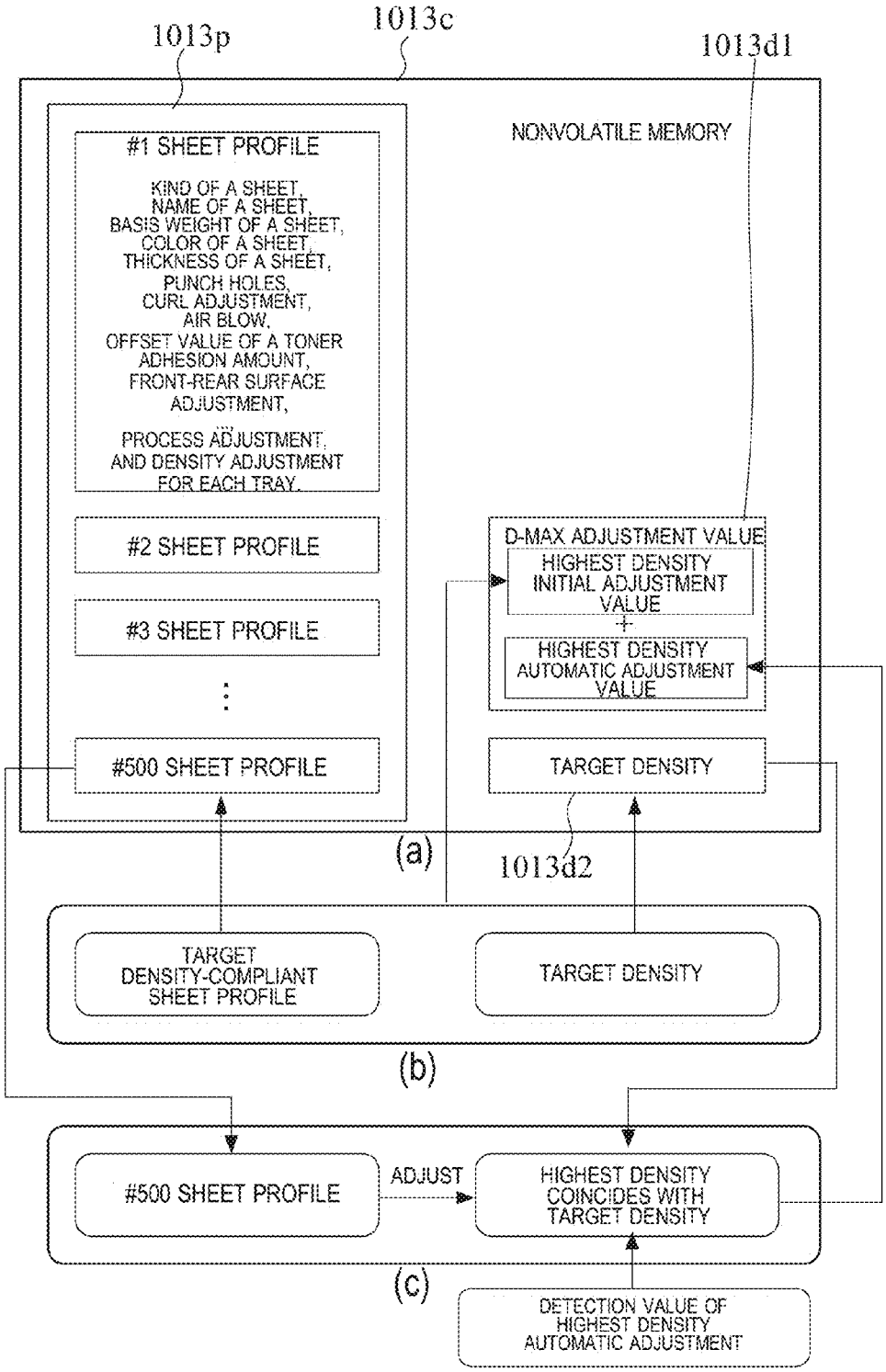
FIG. 4 is an explanatory diagram showing an example of settings in the embodiment.

In FIG. 4, FIG. 4(*a*) shows schematically a sheet profile 1013*p*, a D-MAX adjustment value 1013*d*1, and a target density 1013*d*2, which are stored in the nonvolatile memory 1013*c*.

Further, FIG. 4(*b*) shows schematically a situation of input and output of data to the nonvolatile memory 1013*c* in a highest density initial adjustment, and description is given later at the time of describing operations. Furthermore, FIG. 4(*c*) shows schematically a situation of input and output of data to the nonvolatile memory 1013*c* in a highest density automatic adjustment, and description is given later at the time of describing operations.

Here, sheet profiles 1013*p* are provided with respective different identification numbers, for example, "#1", "#2", "#3", . . . , "#500", etc., which are recognized by the control section 101.

Here, the sheet profile is a kind of setting information about sheets used in the image forming apparatus 100, and examples of the setting information items include the kind of a sheet, the name of a sheet, the basis weight of a sheet, the color of a sheet, the thickness of a sheet, punch holes, curl adjustment, air blow, an offset value of a toner adhesion amount, front-rear surface adjustment, . . . , process adjustment, and density adjustment for each tray. It is preferable that the setting information items include at least the kind of a sheet, the basis weight of a sheet, an offset value of a toner adhesion amount, and information on process adjustment.

Further, in the different sheet profiles, such as "#001" to "#500", it is preferable to reserve a predetermined number, for example, #500, beforehand as a target density-compliant sheet profile. The target density-compliant sheet profile (a sheet profile corresponding to a target density) is a sheet profile including sheet settings about a sheet having been used at the time of determining a target density of a density in the highest density initial adjustment.

<Operations of an Image Forming Apparatus>

Hereafter, the operations of this embodiment will be described sequentially. In this embodiment, examples of the highest density adjustment of the image forming apparatus 100 include two kinds of adjustment such as an highest density initial adjustment and an highest density automatic adjustment.

The highest density initial adjustment is a kind of adjustment executed by a customer engineer at an initial stage such as at the time of installing an image forming apparatus 100. The highest density initial adjustment is performed in order to correct the peculiar characteristic of a process unit configured to execute processing at processes of electrostatically charging, exposing, developing, and transferring.

The highest density automatic adjustment is a kind of adjustment executed by a user at an arbitrary time after the highest density initial adjustment, for example, at the time of starting use of an image forming apparatus on a daily basis. The highest density automatic adjustment is performed so as to detect a density of a density patch formed on a sheet by the printer section 150 with a density sensor and to adjust the printer section 150 to make the highest density coincide with a predetermined target density in order to suppress a characteristic change accompanying environmental fluctuation or the aged deterioration of a process unit.

Further, in the image forming apparatus 100 for which the highest density initial adjustment and the highest density automatic adjustment have been executed, an image is formed on a condition that the highest density in the printer section 150 is controlled by using a D-MAX adjustment value 1013*d*1 (refer to FIG. 4) in which the highest density initial adjustment value and the highest density automatic adjustment value are added together.

<Outline of the Highest Density Initial Adjustment>

Here, the outline of the highest density initial adjustment by a customer engineer is explained. At the time of the highest density initial adjustment, a customer engineer determines a sheet to be used in the highest density adjustment (Step S11 in FIG. 5). In order to administrate the highest density appropriately, the same sheet as that used at the time that a customer engineer has determined a target density in the highest density initial adjustment is used also in the highest density automatic adjustment by a user.

Figure 5:
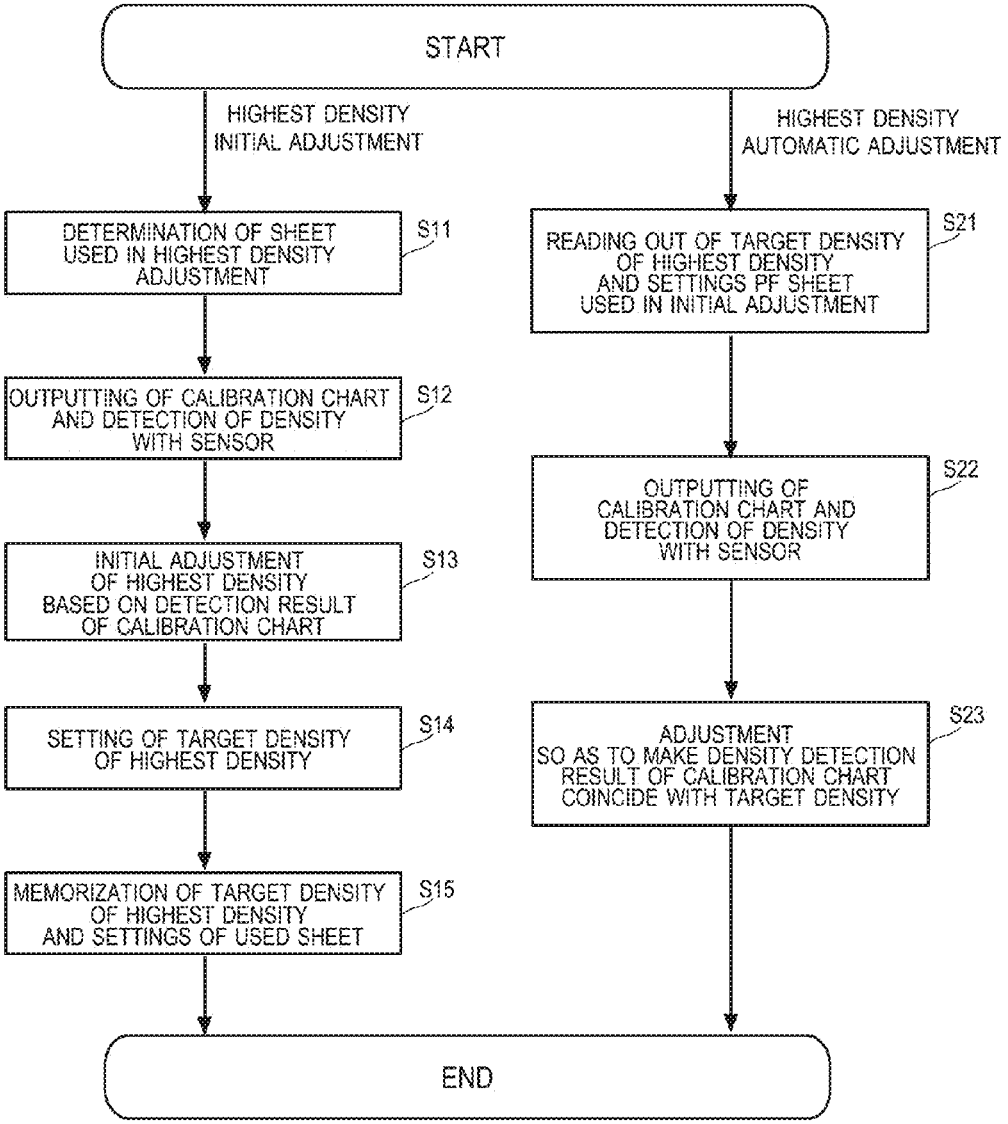
FIG. 5 is a flowchart showing the operation of the embodiment.

Successively, in accordance with the control of the control section 101, a calibration chart is output on the determined sheet, and a patch with the highest density in the calibration chart is detected with the density sensor 220 or an external density sensor (Step S12 in FIG. 5). Here, the control section 101 receives the detection result by the density sensor 220 or the external density sensor. Further, in accordance with the control of the control section 101, the highest density is initially adjusted based on the detection result of the calibration chart (Step S13 in FIG. 5). Furthermore, in accordance with the control of the control section 101, a target density with reference to the highest density is set up (step S14 in FIG. 5), and the set-up target density and the used sheet setting (sheet profile) are memorized in the nonvolatile memory 1013*c* (Step S15 in FIG. 5).

<Outline of the Highest Density Automatic Adjustment>

Here, the outline of the highest density automatic adjustment by a user is explained. At the time of the highest density automatic adjustment, in order to administrate the highest density appropriately, the sheet setting of the sheet used in the highest density initial adjustment is read out from the nonvolatile memory 1013*c* so as to use the same sheet as that used at the time that the customer engineer has determined the target density in the highest density initial adjustment. Also, the target density of the highest density is read out from the nonvolatile memory 1013*c* (Step S21 in FIG. 5). At the time of executing the highest density automatic adjustment, in accordance with the control of the control section 101, a sheet profile for the highest density adjustment and the target density of the highest density are read out from the nonvolatile memory 1013*c*.

Successively, in accordance with the control of the control section 101, a calibration chart is output on the determined sheet, and a patch with the highest density in the calibration chart is detected with the density sensor 220 or the external density sensor (Step S22 in FIG. 5). Here, the control section 101 receives the detection result by the density sensor 220 or the external density sensor. Further, in accordance with the control of the control section 101, the highest density is automatically adjusted so as to make the detection result in the calibration chart and the target density coincide with each other (Step S23 in FIG. 5).

<Detail of the Highest Density Initial Adjustment>

Hereafter, with reference to a flowchart shown in FIG. 6, and an explanatory drawing of a screen shown in each of FIG. 7 and later, the highest density initial adjustment by a customer engineer is described in detail.

The customer engineer operates the operating section 122 while referring to the display screen 123G11 of the display section 123, thereby operating "Service", "Process adjustment", "Drum characteristic adjustment", and to "Highest density initial adjustment" (A1 in FIG. 7) from the usual screen menu. With this, the control section 101 displays the display screen 123G12 (FIG. 8) of the highest density initial adjustment on the display section 123 (Step S101 in FIG. 6). On the display screen of the highest density initial adjustment in FIG. 8, the highest density initial adjustment values are displayed with ten steps in plus and minus direction in each color of yellow, magenta, cyan, and black.

Figure 6:
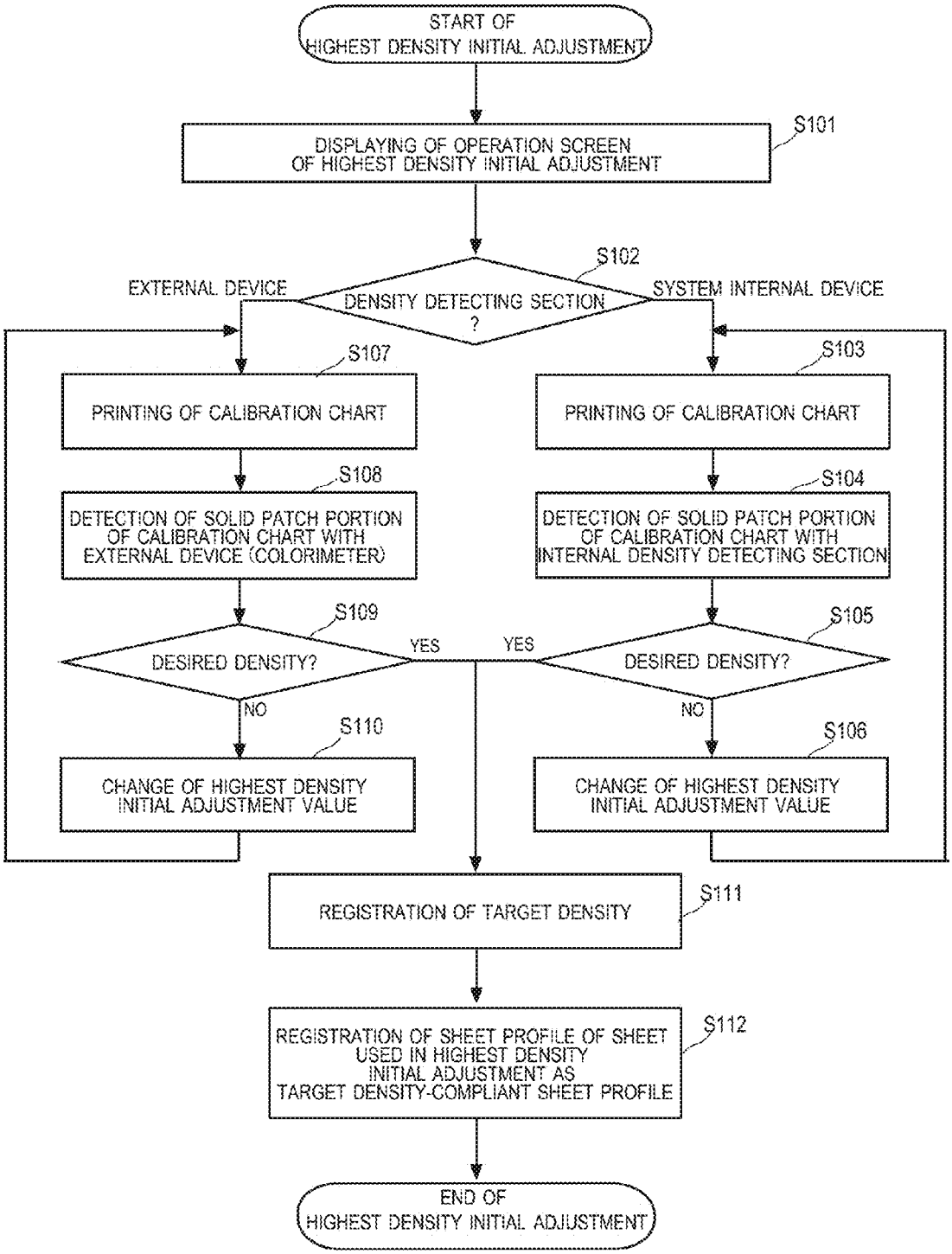
FIG. 6 is a flowchart showing the operation of the embodiment.
Figure 7:
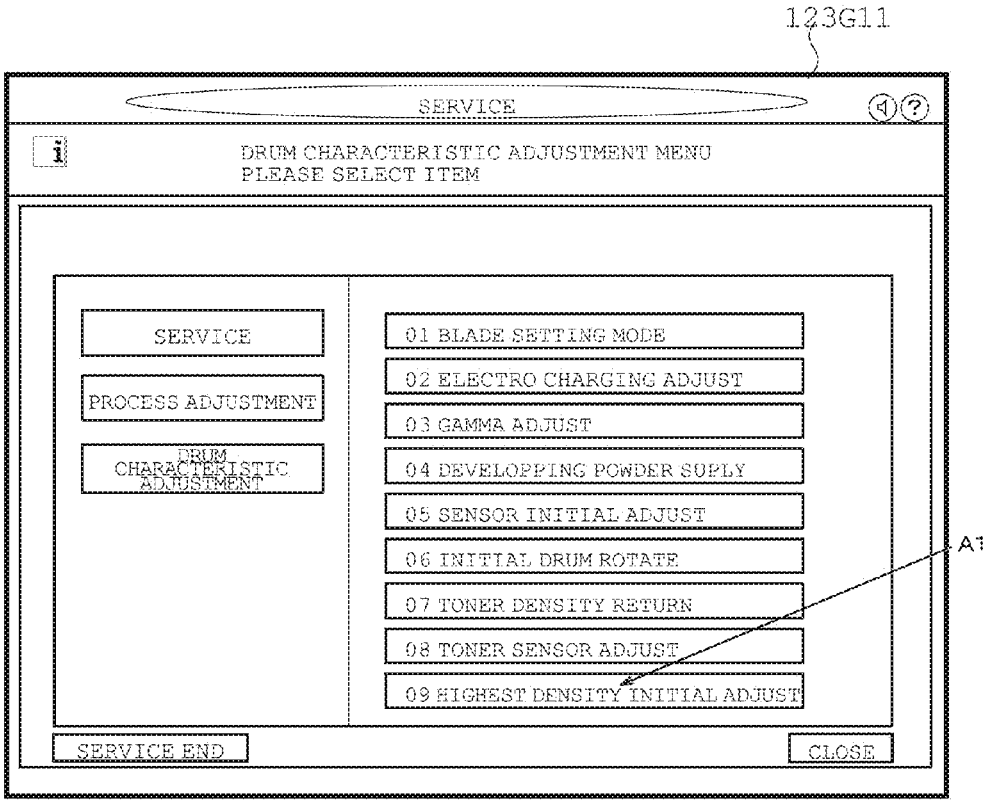
FIG. 7 is an explanatory drawing showing an example of a screen when an image forming apparatus of the embodiment operates.

Here, whether the density detection in the highest density initial adjustment is performed with the density sensor 220 being a system internal device or the not-shown external device is selected by the customer engineer (Step S102 in FIG. 6).

Figure 8:
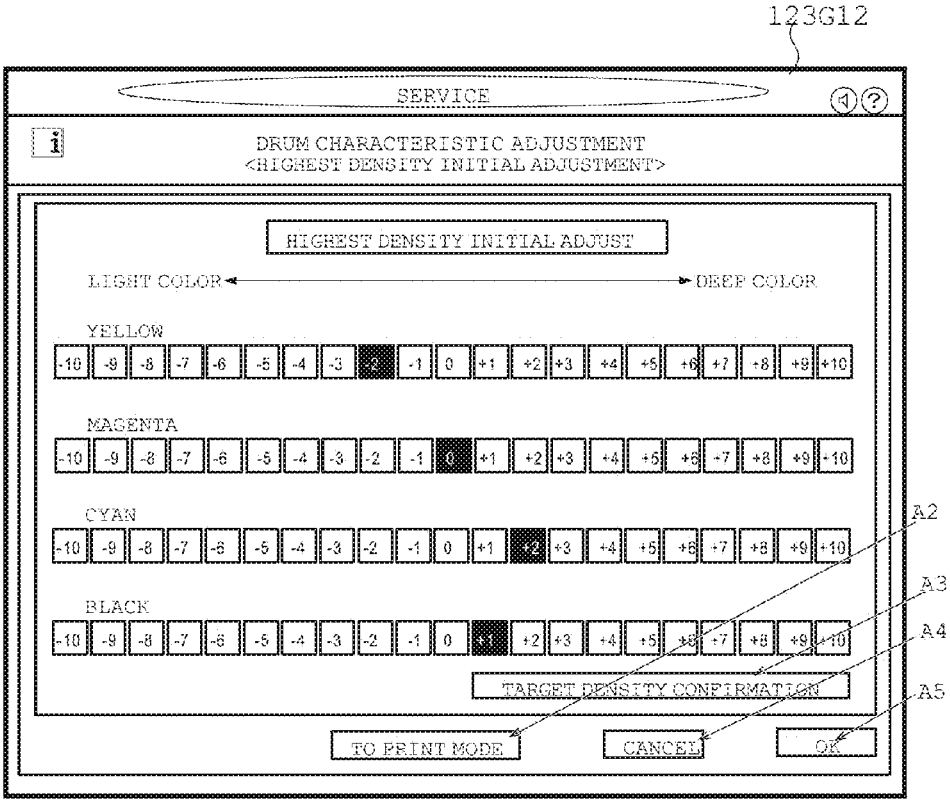
FIG. 8 is an explanatory drawing showing an example of a screen when the image forming apparatus of the embodiment operates.

In the case where the density detection is performed with the density sensor 220 being a system internal device ("system internal device" at Step S102 in FIG. 6), when "To print mode" (A2 in FIG. 8) is selected by the customer engineer on the display screen 123G12 in FIG. 8, in accordance with the control of the control section 101, the display screen 123G13 (FIG. 9) is displayed on the display section.

Figure 9:
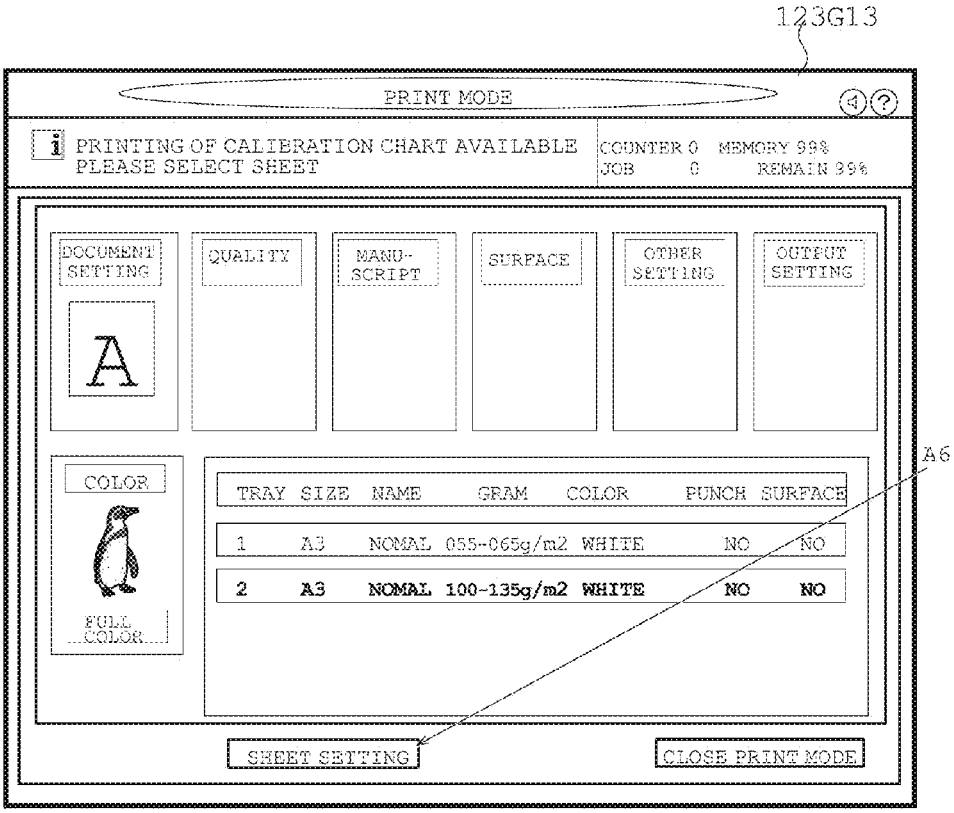
FIG. 9 is an explanatory drawing showing an example of a screen when the image forming apparatus of the embodiment operates.

The display screen 123G13 in FIG. 9 is a screen to input an instruction to print a calibration chart in the highest density initial adjustment. On the display screen 123G13 in FIG. 9, the customer engineer determines a sheet to be used in the highest density initial adjustment by depressing the tab (A6 in FIG. 9) of "Sheet setting", and then, depresses a start button disposed in the operating section 122.

When the start button is depressed on a condition of the display screen 123G13 shown in FIG. 9, in accordance with the control of the control section 101, a calibration chart is printed on a predetermined sheet (Step S103 in FIG. 6). The sheet on which the calibration chart is printed is conveyed from the image forming apparatus 100 to the intermediate processing apparatus 200, and then, in accordance with the control of the control section 101 and the control section 201, the density of a patch included in the calibration chart is detected by the density sensor 220 (Step S104 in FIG. 6). When the printing of the calibration chart has been completed, in accordance with the control of the control section 101, the display screen 123G12 (FIG. 8) is displayed on the display section 123.

Figure 10:
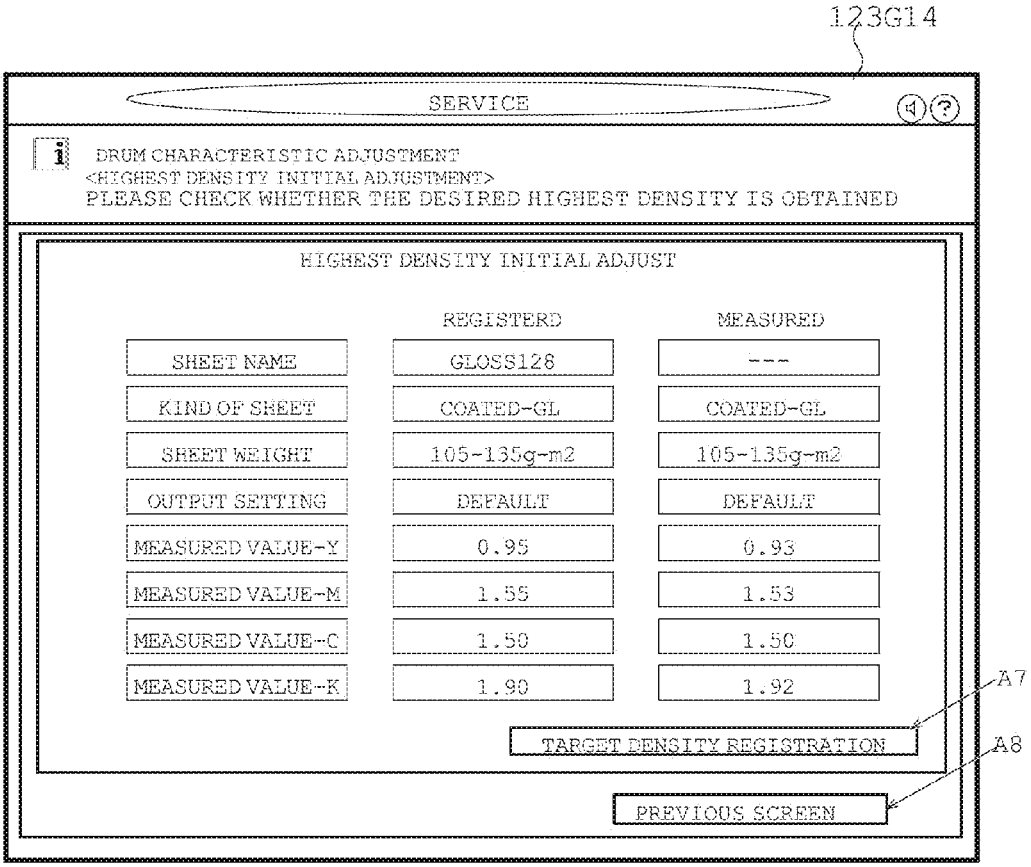
FIG. 10 is an explanatory drawing showing an example of a screen when the image forming apparatus of the embodiment operates.

Here, if the customer engineer selects the tab (A3 in FIG. 8) of "Target density confirmation" on the display screen 123G12 in FIG. 8, in accordance with the control of the control section 101, a highest density initial adjustment result confirming screen 123G14 (refer to FIG. 10) is displayed on the display section 123. The customer engineer checks the detection result of the calibration chart with the highest density initial adjustment result confirming screen 123G14, and checks whether the desired highest density is obtained (Step S105 in FIG. 6).

In the case where the customer engineer judges that the desired highest density is not obtained (NO at Step S105 in FIG. 6), when the customer engineer operates the tab (A8 in FIG. 10) of "Previous screen", in accordance with the control of the control section 101, the display screen 123G12 (FIG. 8) capable of adjusting the highest density initial adjustment value is displayed on the display section 123.

Here, the customer engineer adjusts the highest density initial adjustment value of each color on the display screen 123G12 (Step S106 in FIG. 6), and performs repeatedly the printing and the detecting (Step S103 to in FIG. 6) of the above-mentioned calibration chart until it is judged that the desired highest density has been obtained. With such adjustment of the highest density initial adjustment value, "the highest density initial adjustment value" in the D-MAX adjustment value 1013*d*1 in the nonvolatile memory 1013*c* is changed.

Figure 11:
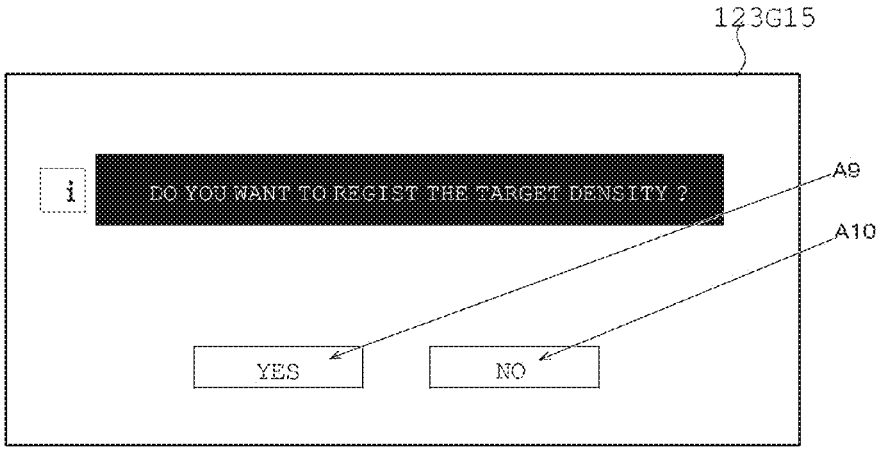
FIG. 11 is an explanatory drawing showing an example of a screen when the image forming apparatus of the embodiment operates.

On the other hand, in the case where the customer engineer judges via the highest density initial adjustment result confirming screen 123G14 (refer to FIG. 10) that the desired highest density is obtained (YES at Step S105 in FIG. 6), when the customer engineer operates the tab (A7 in FIG. 10) of "Target density registration", in accordance with the control of the control section 101, a pop-up screen 123G15 (refer to FIG. 11) to ask the registration of the target density is displayed on the display section 123.

On the pop-up screen 123G15 (refer to FIG. 11) to ask the registration of the target density, when the customer engineer operates the tab (A10 in FIG. 11) of "No", in accordance with the control of the control section 101, the highest density initial adjustment result confirming screen 123G14 (refer to FIG. 10) is displayed on the display section 123.

Figure 12:
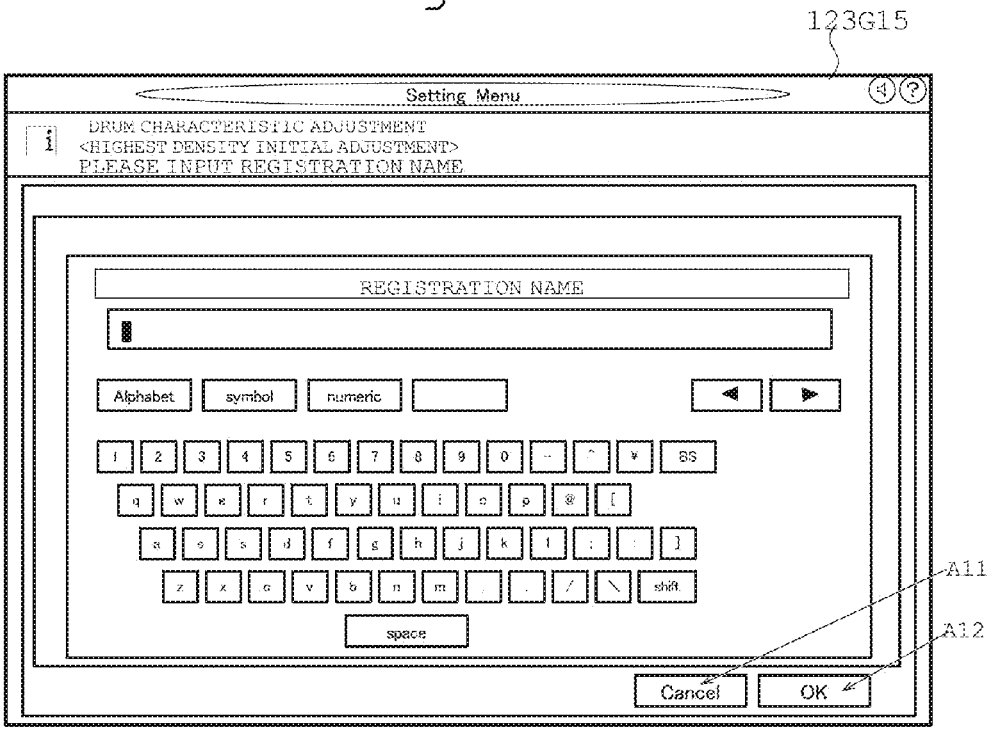
FIG. 12 is an explanatory drawing showing an example of a screen when the image forming apparatus of the embodiment operates.

On the pop-up screen 123G15 (refer to FIG. 11) to ask the registration of the target density, when the customer engineer operates the tab (A9 in FIG. 11) of "Yes", in accordance with the control of the control section 101, a registration name inputting screen 123G16 (refer to FIG. 12) at the time of registering the target density is displayed on the display section 123.

On the registration name inputting screen 123G16 (refer to FIG. 12), when the customer engineer operates the tab (A11 in FIG. 12) of "Cancellation", in accordance with the control of the control section 101, the display screen 123G12 (FIG. 8) capable of adjusting the initial adjustment value is displayed on the display section 123, and the above-mentioned operation can be repeated.

On the registration name inputting screen 123G16 (refer to FIG. 12), when the customer engineer inputs a registration name and then operates the tab (A12 in FIG. 12) of "OK", in accordance with the control of the control section 101, the target density (the target value of the highest density automatic adjustment) is registered as "a target density" 1013*d*2 in the nonvolatile memory 1013*c* (Step S111 in FIG. 6).

Further, in accordance with the control of the control section 101, in parallel to the registration of the target density, a sheet profile (a target density-compliant sheet profile) including the sheet setting of a sheet having been used in the highest density initial adjustment is registered as "a sheet profile #500" in the nonvolatile memory 1013*c* (Step S112 in FIG. 6). Here, it may be also possible to register the sheet setting of a sheet having been used in the highest density initial adjustment as sheet setting used in the highest density automatic adjustment, not as a sheet profile.

FIG. 4(*b*) shows schematically change and registration of the highest density initial adjustment value, registration of the target density, and registration of the target density-compliant sheet profile for the nonvolatile memory 1013*c* in the highest density initial adjustment as described in the above.

Although the above description in S103 to S106 is given for the case where the density sensor 220 serving as a system internal device is used for detection of the calibration chart, the processing to detect the density with an external device in Steps S107 to S110 is the same as that in the above case. For this reason, the overlapping description is omitted. In the case where an external device performs the density detection, the external device is connected to the communication I/F section 112, whereby the control section 101 can read out a detection value.

<Detail of the Highest Density Automatic Adjustment>

Hereafter, description is given in detail for the highest density automatic adjustment by a user at the time of using the image forming apparatus 100 with reference to the flowchart shown in FIG. 13 and the explanatory drawing of a screen shown in each of FIG. 14 and later.

The user operates the operating section 122 while referring to the display screen 123G21 of the display section 123, and operates "Service", "Process adjustment", and to "Highest density automatic adjustment" (B1 in FIG. 14) from the usual screen menu.

Figure 14:
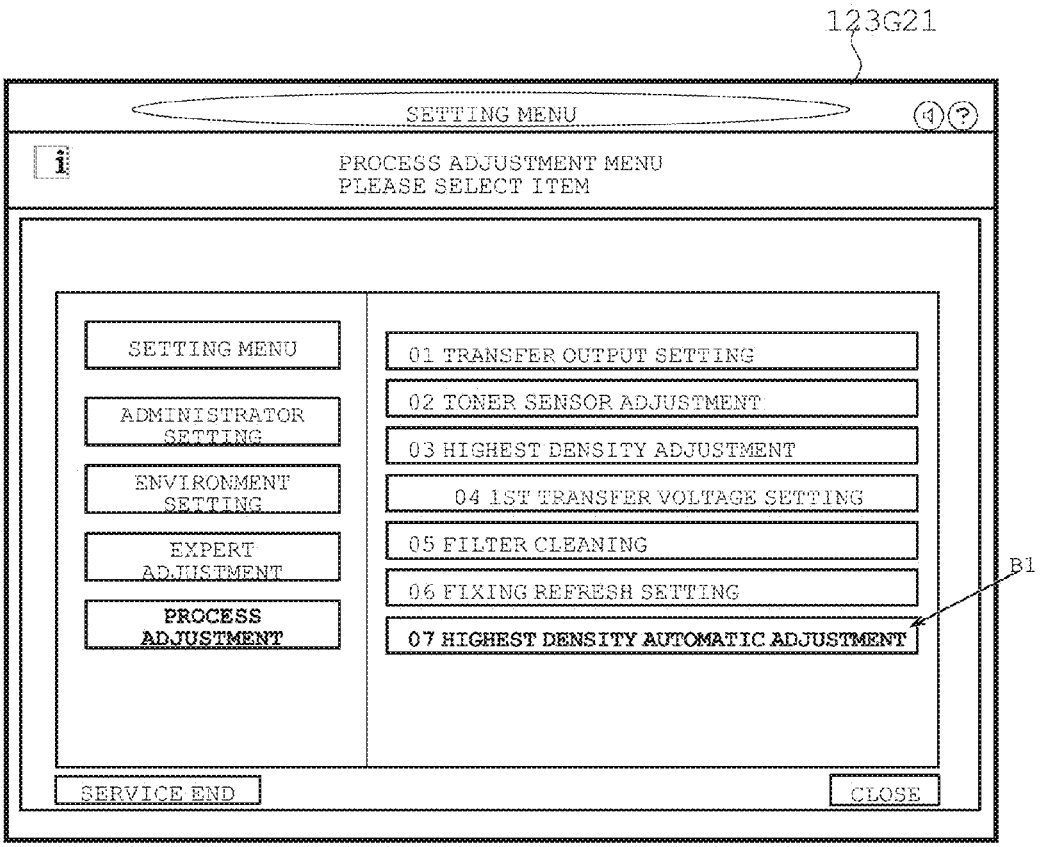
FIG. 14 is an explanatory drawing showing an example of a screen when the image forming apparatus of the embodiment operates.

On the display screen shown in FIG. 14, the control section 101 displays the item of "Highest density automatic adjustment" only in the process adjustment menu for a user. Further, in the case where the density detection cannot be performed by the density sensor 220, the control section 101 makes the item of "Highest density automatic adjustment" to a condition of non-display or un-selectable. Furthermore, in the case where the target density to be registered in the highest density initial adjustment does not exist in the nonvolatile memory 1013*c*, the highest density automatic adjustment cannot be performed. For this reason, the control section 101 makes the item of "Highest density automatic adjustment" to a condition of non-display or un-selectable.

Figure 13:
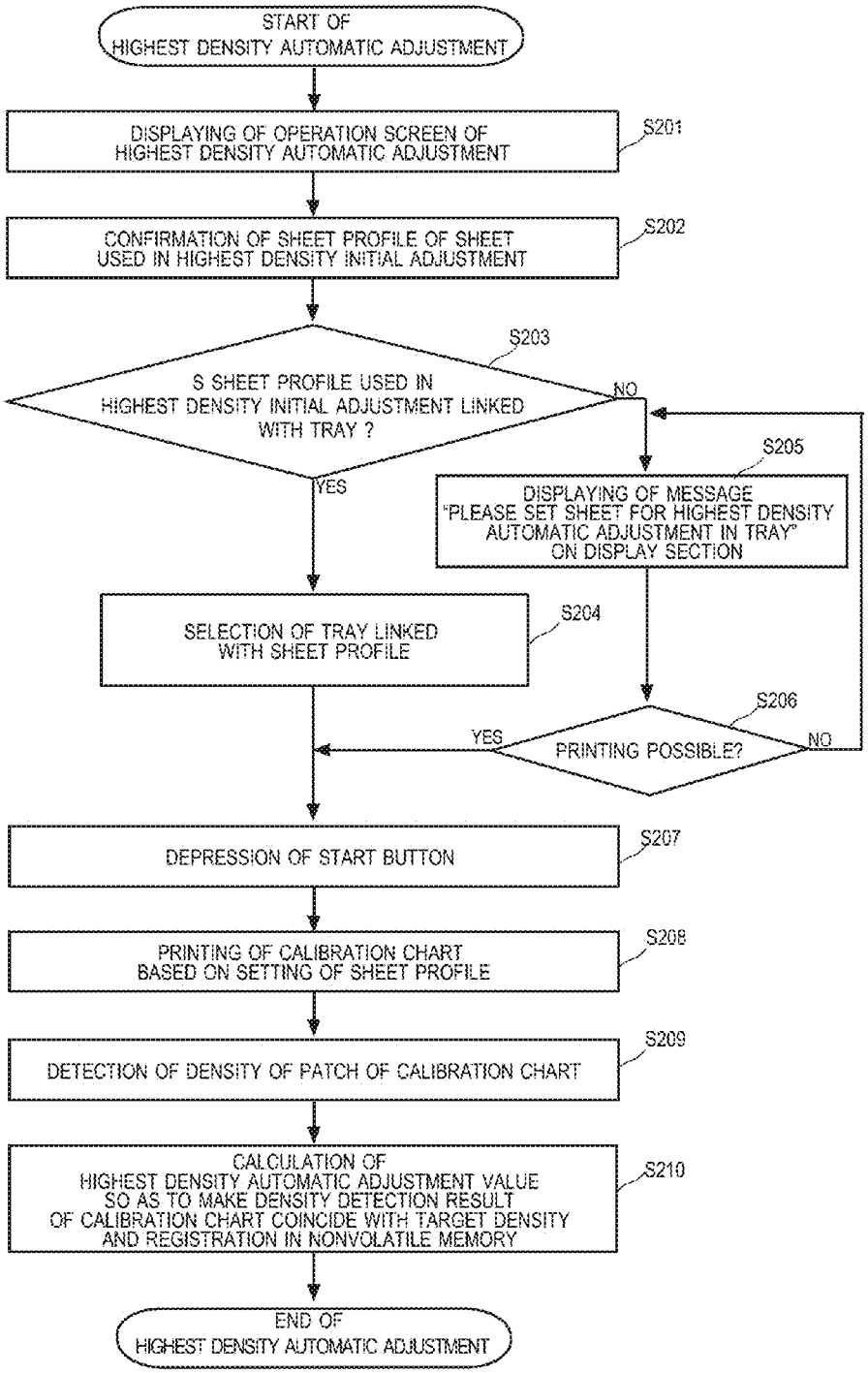
FIG. 13 is a flowchart which shows the operation of the embodiment.

Then, when the user operates "Highest density automatic adjustment" (B1 in FIG. 14), the control section 101 displays the display screen 123G22 (FIG. 15) of the highest density automatic adjustment on the display section 123 (Step S101 in FIG. 13). On the display screen 123G22 shown in FIG. 15, the target density output condition, the target density, etc. are displayed. Incidentally, on the display screen 123G22 shown in FIG. 15, the highest density automatic adjustment has not been completed. Accordingly, the item of density after adjustment is displayed as " - - - " etc.

Figure 15:
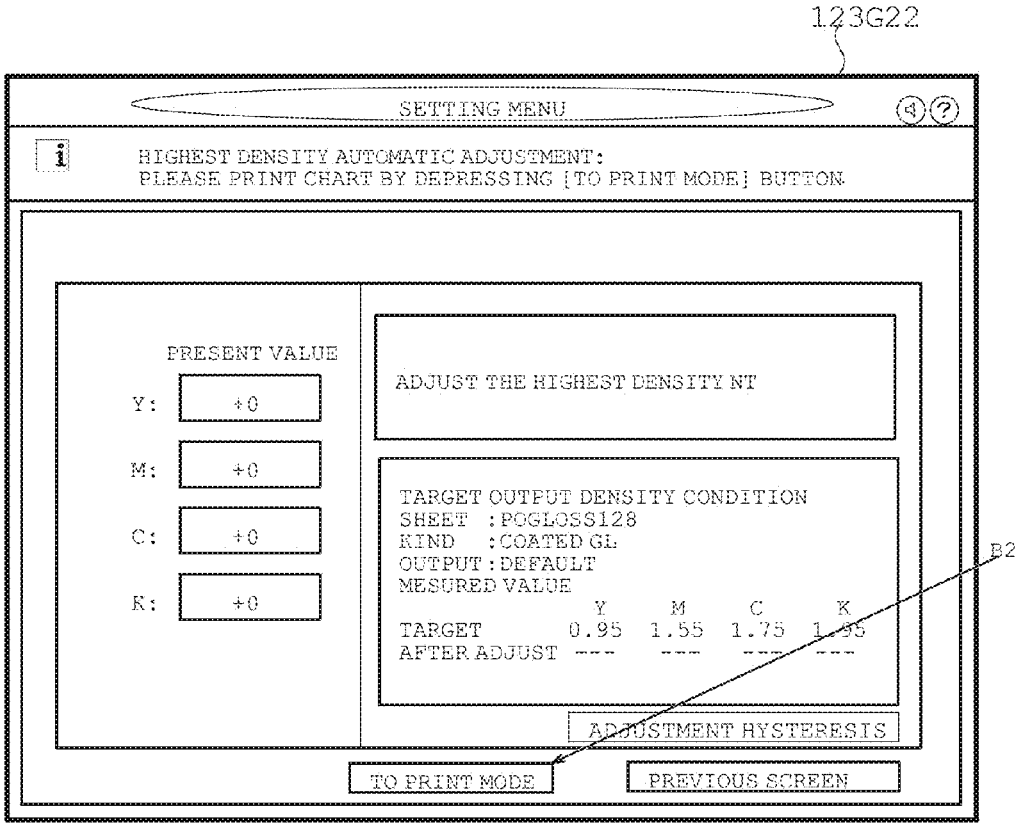
FIG. 15 is an explanatory drawing showing an example of a screen when the image forming apparatus of the embodiment operates.
Figure 16:
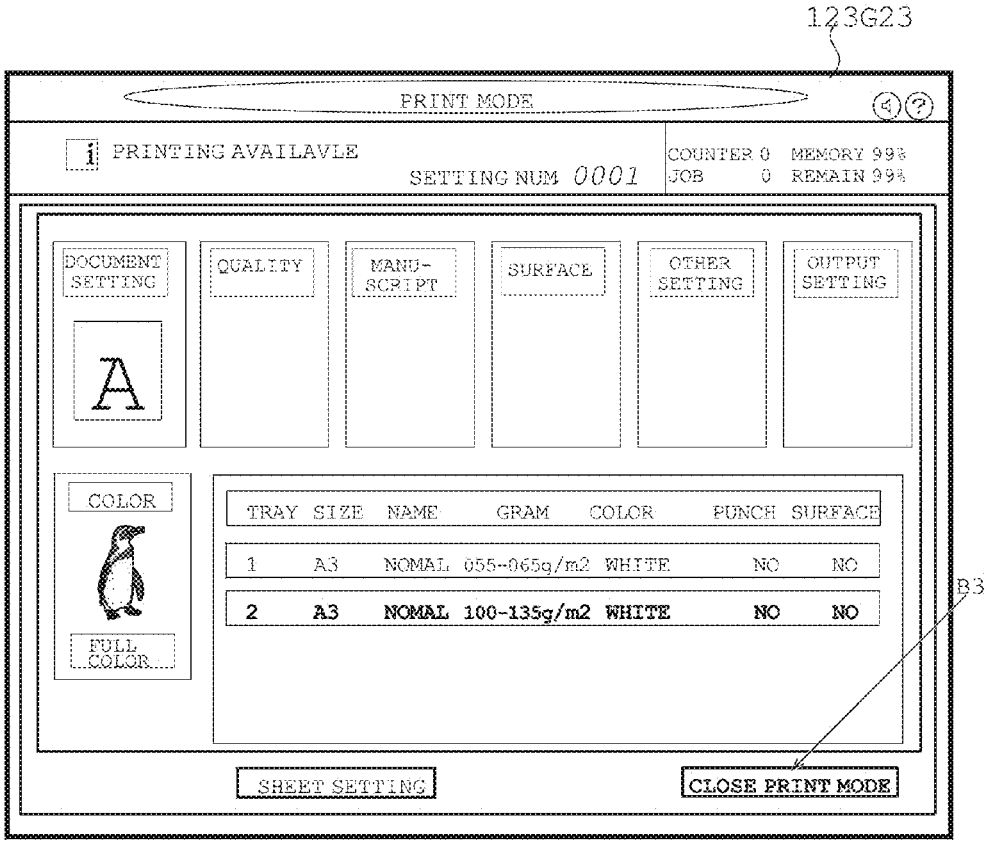
FIG. 16 is an explanatory drawing showing an example of a screen when the image forming apparatus of the embodiment operates.

Further, on the display screen 123G22 shown in FIG. 15, when the user operates the tab (B2 in FIG. 15) of "to print mode", in accordance with the control of the control section 101, the display screen 123G23 (FIG. 16) is displayed on the display section. FIG. 16 shows the display screen 123G23 to input an instruction to print a calibration chart in the highest density automatic adjustment.

On the display screen 123G23 shown in FIG. 16, when the user operates the tab (B3 in FIG. 16) of "Close print mode", in accordance with the control of the control section 101, the current screen returns to the display screen 123G22 shown in FIG. 15 which is a previous screen by one screen before the current screen.

On the condition that the display screen 123G23 shown in FIG. 16 is displayed, the control section 101 judges whether the tray correlated with the sheet profile (the target density-compliant sheet profile, the sheet profile registered at #500 in the nonvolatile memory 1013*c*) for the highest density automatic adjustment registered at #500 in the nonvolatile memory 1013*c* exists in the sheet feeding section 105 (Step S202 in FIG. 13).

If the tray correlated with the sheet profile registered at #500 in the nonvolatile memory 1013*c* does not exist in the sheet feeding section 105 (NO at Step S203 in FIG. 13), in accordance with the control of the control section 101, a warning message, such as "Please set sheets for the highest density automatic adjustment in a tray", is displayed with a pop-up screen on the display screen 123G23 shown in FIG. 16.

At this time, a start button disposed on the operating section 122 is made to a condition incapable of being operated, so that the user cannot start printing of a calibration chart. Incidentally, although the sheets of the highest density automatic adjustment are accommodated in either one of trays, in the case where such a tray is not correlated with the sheet profile registered at #500 in the nonvolatile memory 1013*c*, it may be also possible for the user to correlate the sheet profile with the tray at this time.

However, even when sheet is the same as that in the sheet profile registered at #500 in the nonvolatile memory 1013*c*, if the density detection cannot be performed with the density sensor 220 due to the relation of sheet size, it is preferable to display a warning message, such as "Please set sheets for the highest density automatic adjustment to a tray", with a pop-up screen etc.

In the case where the tray correlated with the sheet profile registered at #500 in the nonvolatile memory 1013*c* exists in the sheet feeding section 105 (YES at Step S203 in FIG. 13), or in the case where printing is made possible by the replenishment of sheets by the user in accordance with the above warning message or by the correlation of the sheet profile with a tray (YES at Step S206 in FIG. 13), the tray correlated with the sheet profile registered at #500 in the nonvolatile memory 1013*c* is selected by the control section 101 as a tray at the time of printing a calibration chart in the highest density automatic adjustment (Step S204 in FIG. 13).

In this way, if the tray correlated with the sheet profile registered at #500 in the nonvolatile memory 1013*c* is selected, a start button disposed on the operating section 122 becomes an operational condition. Successively, a user becomes a condition capable of instructing to start printing of a calibration chart.

It is a principle to correlate a sheet profile with a tray. However, at the time of adjusting the highest density, there may exist a function to use a target density-compliant sheet profile without correlating it with a tray. For example, without changing the setting of a tray, the highest density automatic adjustment can be performed by putting sheets corresponding to the target density-compliant sheet profile by only the required number of sheets into a tray. With the operation in this way, it becomes possible to perform the highest density automatic adjustment without performing a troublesome setting operation for a tray.

Here, the user depresses the start button disposed on the operating section 122 (Step S207 in FIG. 13). When the start button is depressed in the condition of the display screen 123G23 shown in FIG. 16, in accordance with the control of the control section 101, the sheet profile registered at #500 in the nonvolatile memory 1013*c* is applied to a predetermined sheet accommodated in the tray correlated with the sheet profile registered at #500 in the nonvolatile memory 1013*c*, and the calibration chart is printed on the sheet by the printer section 150 (Step S208 in FIG. 13).

At this time, the calibration chart is printed on the condition that the highest density in the printer section 150 is controlled by using the D-MAX adjustment value 1013*d*1 in which the highest density initial adjustment value and the previous highest density automatic adjustment value are added together. However, when the user uses the installed image forming apparatus 100 for the first time, the highest density automatic adjustment value has not yet been registered. For this reason, the calibration chart is printed on the condition that the highest density in the printer section 150 is controlled by using the D-MAX adjustment value of 1013*d*1 of only the highest density initial adjustment value.

Further, the sheet on which the calibration chart is printed is conveyed from the image forming apparatus 100 to the intermediate processing apparatus 200, in accordance with the control of the control section 101 and the control section 201, the density of a patch included in the calibration chart is detected by the density sensor 220 (Step S209 in FIG. 13).

Figure 17:
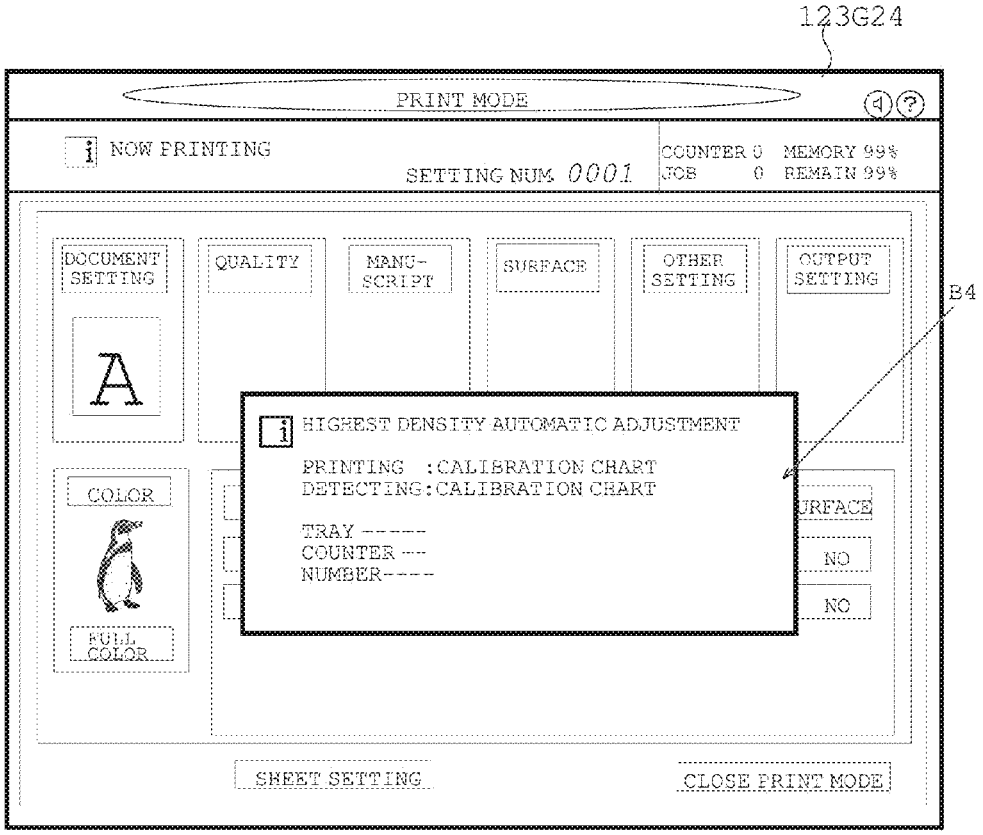
FIG. 17 is an explanatory drawing showing an example of a screen when the image forming apparatus of the embodiment operates.

At the timing when the calibration chart is printed and the density is detected, in accordance with the control of the control section 101, the display screen 123G24 shown in FIG. 17 is displayed on the display section 123. On the display screen 123GG24 shown in FIG. 17, with the pop-up screen (B4 in FIG. 17), the situation of printing the highest density automatic adjustment chart and detecting the density is clearly transmitted to a user.

When the above printing of the calibration chart (Step S208 in FIG. 13) and the density detection (Step S209 in FIG. 13) have been completed, in accordance with the control of the control section 101, a highest density automatic adjustment value is calculated so as to make the density detection value detected with the density sensor 220 coincide with the target density 1013*d*2 memorized in the nonvolatile memory 1013*c*. That is, the highest density automatic adjustment value is calculated based on a difference between the density detection value detected with the density sensor 220 and the target density 1013*d*2 memorized in the nonvolatile memory 1013*c*.

Then, the highest density automatic adjustment value is registered in "highest density automatic adjustment value" in the D-MAX adjustment value 1013*d*1 in the nonvolatile memory 1013*c* by the control of the control section 101 (Step S210 in FIG. 13). Further, when the highest density automatic adjustment value is registered by the highest density automatic adjustment, as shown in FIG. 18, the display screen 123G25 in the condition of displaying the message "The highest density automatic adjustment has been completed" is displayed on the display section 123 by the control of the control section 101.

Figure 18:
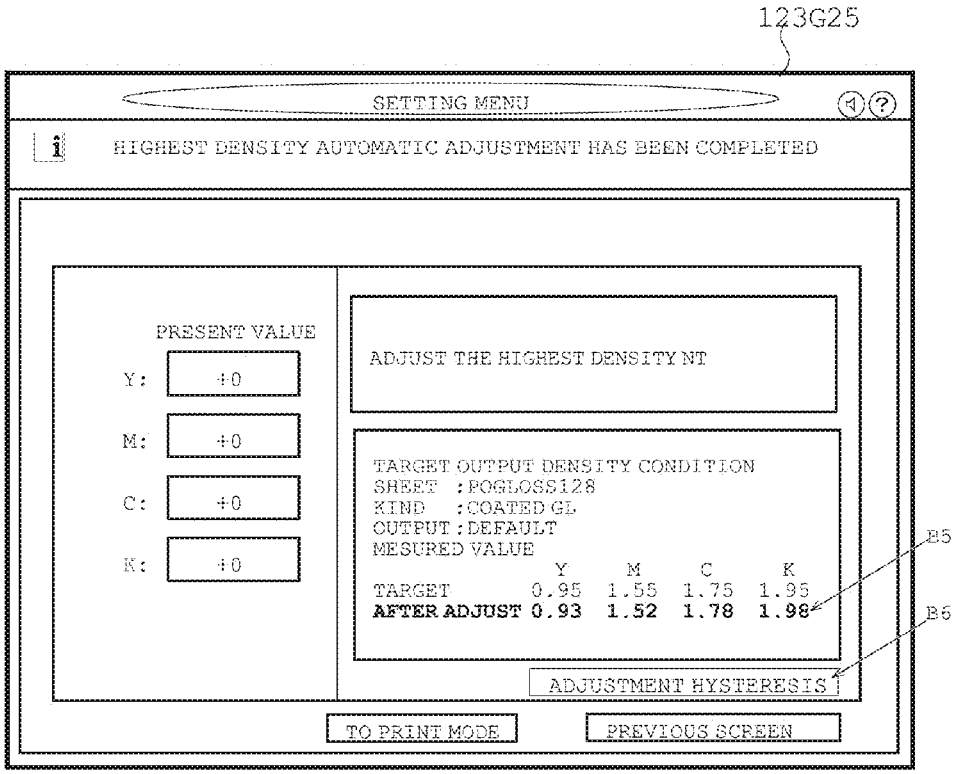
FIG. 18 is an explanatory drawing showing an example of a screen when the image forming apparatus of the embodiment operates.

The above highest density automatic adjustment can be realized by printing a calibration chart on at least one sheet and performing a density detection with the density sensor 220. However, it is also possible to print the calibration chart for confirmation on a condition of controlling the highest density in the printer section 150 by using the D-MAX adjustment value 1013*d*1 in which the highest density initial adjustment value and the highest density automatic adjustment value of this time are added together.

on the condition of controlling the highest density in the printer section 150 by using the D-MAX adjustment value 1013*d*1 in which the highest density initial adjustment value and the highest density automatic adjustment value of this time are added together, the printing of the calibration chart is performed for confirmation and the density is detected with the density sensor 220, whereby it becomes possible to display the density detection result of the density sensor 220 as the density after the highest density automatic adjustment on the display screen 123G25 shown in FIG. 18 (B5 in FIG. 18).

When the highest density automatic adjustment has been performed as mentioned above, it is desirable to detect the highest density after the adjustment and to keep it as the highest density automatic adjustment history at some region in the nonvolatile memory 1013*c*.

Figure 19:
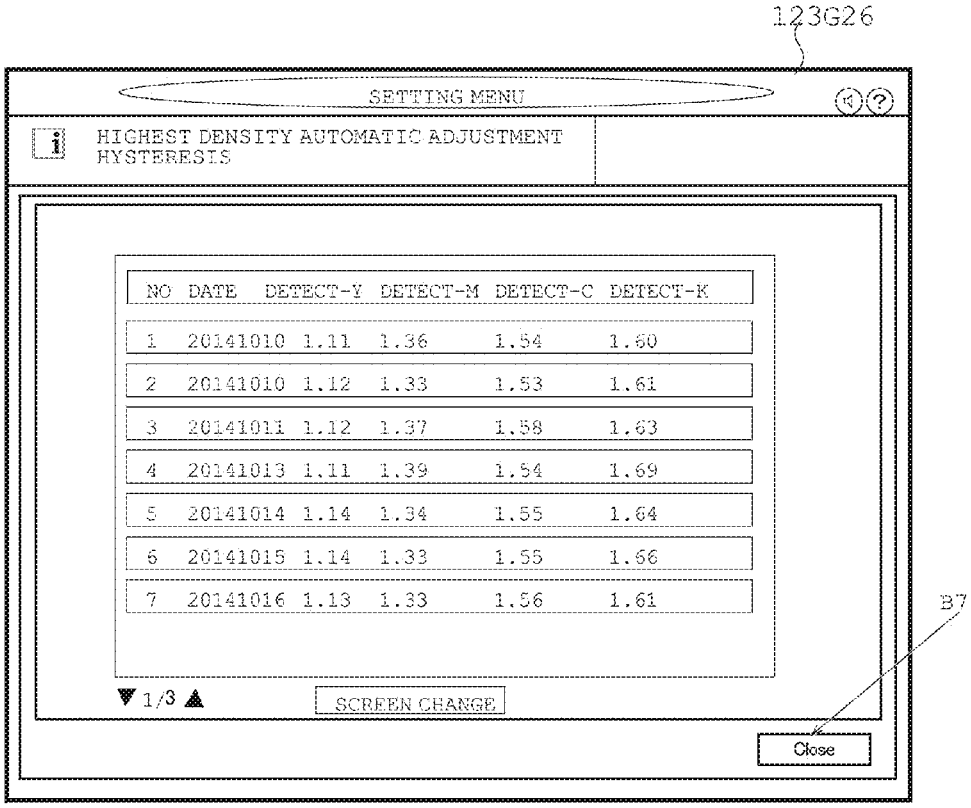
FIG. 19 is an explanatory drawing showing an example of a screen when the image forming apparatus of the embodiment operates.

Further, when a user operates the tab (B6 in FIG. 18) of "Adjustment hysteresis" on the display screen 123G25 shown in FIG. 18, in accordance with the control of the control section 101, a display screen 123G26 (refer to FIG. 19) is displayed on the display section 123. The display screen 123G26 indicates the highest density after the adjustment by the above-mentioned highest density automatic adjustment as a list for every adjustment date. On the display screen 123G26 shown in FIG. 19, when the tab (B7 in FIG. 18) of "Closing" is operated by the user, in accordance with the control of the control section 101, the current screen returns to the display screen 123G25 shown in FIG. 18 which is a previous screen by one screen before the current screen.

<Effects Obtained by this Embodiment>

According to the above embodiment, the highest density adjustment is separated into the highest density initial adjustment by a customer engineer and the highest density automatic adjustment by a user. In the highest density automatic adjustment performed by a user, the adjustment of the highest density is automatically performed by the printing of a calibration chart and the detection of density. Accordingly, it becomes possible to perform appropriate highest density automatic adjustment simply.

Conventionally, in order to adjust the desired highest density, a user is required to repeatedly perform the printing of a calibration chart, the detection of density, and the changing of the highest density initial adjustment value. However, in this embodiment, it is not required to repeat such operations.

Further, according to the above embodiment, the highest density adjustment is separated into the highest density initial adjustment by a customer engineer and the highest density automatic adjustment by a user. In the highest density automatic adjustment performed by a user, the adjustment of the highest density is automatically performed by the printing of a calibration chart and the detection of density. Accordingly, judgment and manual adjustment by a user are omitted. As a result, it becomes possible to perform appropriate highest density automatic adjustment simply.

Further, according to the above embodiment, it becomes unnecessary for a user to keep in mind the sheet used for the highest density initial adjustment by the customer engineer and its sheet setting. With this, it becomes unnecessary to do a work to reproduce the sheet setting of the sheet used for the initial adjustment of the highest density as a sheet profile. As a result, it becomes possible to reduce the time for the work to reproduce the sheet setting. Further, it becomes possible to eliminate a fear that it may become impossible to adjust a desired highest density appropriately due to a mistake in the reproducing of the sheet setting. As a result, it becomes possible to adjust a desired highest density appropriately, without performing troublesome setting operations.

Further, in this embodiment, it is possible to perform two kinds of density adjustment of the highest density initial adjustment to determine the target density of the highest density and the highest density automatic adjustment to adjust the highest density at an arbitrary time. Here, a target density-compliant sheet profile of the sheet used in the highest density initial adjustment and the target density of the highest density are memorized in the memory section, and the highest density automatic adjustment is performed based on the target density-compliant sheet profile and the target density. By doing in this way, it becomes unnecessary to keep in mind the sheet used for the highest density initial adjustment and its sheet setting. Accordingly, it becomes unnecessary to do a work to reproduce the sheet profile of the sheet used for the highest density initial adjustment. As a result, it becomes possible to reduce the time for the work to reproduce the sheet setting. Further, it becomes possible to eliminate a fear that it may become impossible to adjust a desired highest density appropriately due to a mistake in the reproducing of the sheet setting. With this, it becomes possible to adjust a desired highest density appropriately, without performing troublesome setting operations.

The target density-compliant sheet profile is memorized in the condition of including the kind of a sheet, the basis weight of the sheet, an offset value of a toner adhesion amount, and information on process adjustment, whereby it becomes unnecessary to keep in mind the sheet used for the initial adjustment of the highest density and its sheet setting. With this, it becomes unnecessary to do a work to reproduce the sheet setting of the sheet used for the initial adjustment of the highest density as a sheet profile. As a result, it becomes possible to reduce the time for the work to reproduce the sheet setting. Further, it becomes possible to eliminate a fear that it may become impossible to adjust a desired highest density appropriately due to a mistake in the reproducing of the sheet setting. With this, it becomes possible to adjust a desired highest density appropriately, without performing troublesome setting operations.

Further, the target density-compliant sheet profile is memorized at a predetermined memory position in the memory section. Then, at the time of adjusting a highest density, the target density-compliant sheet profile and the target density are read from the memory section. With this, it becomes possible to adjust a desired highest density appropriately, without performing troublesome setting operations.

Further, irrespective of the function to correlate a sheet profile with a tray in accordance with the setting of the tray, at the time of adjusting the highest density, it becomes possible to use the target density-compliant sheet profile without correlating it with the tray. With this, it becomes possible to adjust a desired highest density appropriately, without performing troublesome setting operations regarding the tray.

OTHER EMBODIMENTS

As mentioned above, although the embodiment of the present invention has been described with reference to the drawings, the concrete constitution should not be restricted to the constitution shown in the embodiment. That is, as long as modification and addition are made in a range of not deviating from the intention of the present invention, such modification and addition are included in the present invention.

What is claimed is:

1. An image forming apparatus, comprising:

a memory section which memorizes various kinds of information;

an image forming section which forms an image with toner on a sheet; and a control section which controls the formation of the image by the image forming section;

wherein the control section performs density adjustment by forming a density patch on a sheet with the image forming section, receiving a density detection result of the density patch, and adjusting the image forming section based on the density detection result such that a highest density with the toner coincides with a target density;

wherein the control section memorizes the target density and a target density-compliant sheet profile in the memory section, wherein the target density-compliant sheet profile is a sheet profile including sheet setting for a sheet used at the time of determining the target density; and wherein after having memorized the target density-compliant sheet profile and the target density, the control section performs density adjustment by forming another density patch on the sheet with the image forming section based on the target density-compliant sheet profile, receiving a density detection result of the other density patch, and adjusting the image forming section such that a highest density with the toner coincides with the target density.

2. The image forming apparatus according to claim 1, wherein the control section performs two kinds of density adjustment including a highest density initial adjustment and a highest density automatic adjustment, and wherein in the highest density initial adjustment, the target density is determined to make the highest density coincide with the target density, and in the highest density automatic adjustment, at an arbitrary time after having determined the target density in the highest density initial adjustment, the highest density of the other density patch is detected, and the image forming section is adjusted so as to make the highest density coincide with the target density.

3. The image forming apparatus according to claim 1, wherein the sheet setting in the target density-compliant sheet profile includes at least a kind of a sheet, a basis weight of the sheet, an offset value of a toner adhesion amount, and information on process adjustment.

4. The image forming apparatus according to claim 1, wherein the control section memorizes the target density-compliant sheet profile at a predetermined memory position in the memory section, and at the time of adjusting the highest density, the control section reads out the target density from the memory section, and reads out the target density-compliant sheet profile.

5. The image forming apparatus according to claim 1, further comprising a sheet feeding section provided with a tray for accommodating sheets, wherein the control section correlates the target density-compliant sheet profile with the tray in response to setting of the tray, and at the time of adjusting the highest density, the control section uses the target density-compliant sheet profile without correlating the target density-compliant sheet profile with the tray.

6. The image forming apparatus according to claim 1, further comprising a sheet feeding section provided with a tray for accommodating sheets, wherein when the control section forms the other density patch on the sheet with the image forming section based on the target density-compliant sheet profile, the control section notifies a user to select a tray to be correlated with the target density-compliant sheet profile.

7. The image forming apparatus according to claim 1, further comprising a sheet feeding section provided with a tray for accommodating sheets, wherein when the control section forms the other density patch on the sheet with the image forming section based on the target density-compliant sheet profile, the control section judges whether or not a tray correlated with the target density-compliant sheet profile exists, and if the tray correlated with the target density-compliant sheet profile does not exist, the control section issues a warning.

8. An image forming system, comprising:

a memory section which memorizes various kinds of information;

an image forming section which forms an image with toner on a sheet;

a density detecting section which detects a density of the image formed on the sheet by the image forming section; and a control section which controls the formation of the image by the image forming section;

wherein the control section performs density adjustment by forming a density patch on a sheet with the image forming section, detecting the density of the density patch with the density detecting section, and adjusting the image forming section based on a density detection result detected by the density detecting section such that a highest density with the toner coincides with a target density;

wherein the control section memorizes the target density and a target density-compliant sheet profile in the memory section, wherein the target density-compliant sheet profile is a sheet profile including sheet setting for a sheet used at the time of determining the target density; and wherein after having memorized the target density-compliant sheet profile and the target density, the control section performs density adjustment by forming another density patch on the sheet with the image forming section based on the target density-compliant sheet profile, receiving a density detection result of the other density patch, and adjusting the image forming section such that a highest density with the toner coincides with the target density.

9. The image forming system according to claim 8, wherein the control section performs two kinds of density adjustment including a highest density initial adjustment and a highest density automatic adjustment, and wherein in the highest density initial adjustment, the target density is determined to make the highest density coincide with the target density, and in the highest density automatic adjustment, at an arbitrary time after having determined the target density in the highest density initial adjustment, the highest density of the other density patch is detected by the density detecting section, and the image forming section is adjusted so as to make the highest density coincide with the target density.

10. The image forming system according to claim 8, wherein the sheet setting in the target density-compliant sheet profile includes at least a kind of a sheet, a basis weight of the sheet, an offset value of a toner adhesion amount, and information on process adjustment.

11. The image forming system according to claim 8, wherein the control section memorizes the target density-compliant sheet profile at a predetermined memory position in the memory section, and at the time of adjusting the highest density, the control section reads out the target density from the memory section, and reads out the target density-compliant sheet profile.

12. The image forming system according to claim 8, further comprising a sheet feeding section provided with a tray for accommodating sheets, wherein the control section correlates the target density-compliant sheet profile with the tray in response to setting of the tray, and at the time of adjusting the highest density, the control section uses the target density-compliant sheet profile without correlating the target density-compliant sheet profile with the tray.

13. An image formation control method for controlling an image forming apparatus which comprises a memory section which memorizes various kinds of information; an image forming section which forms an image with toner on a sheet; and a control section which controls the formation of the image by the image forming section; the method comprising:

performing density adjustment by forming a density patch on a sheet with the image forming section, receiving a density detection result of the density patch, and adjusting the image forming section based on the density detection result such that a highest density with the toner coincides with a target density, memorizing the target density and a target density-compliant sheet profile in the memory section, wherein the target density-compliant sheet profile is a sheet profile including sheet setting for a sheet used at the time of determining the target density; and after having memorized the target density-compliant sheet profile and the target density, performing density adjustment by forming another density patch on the sheet with the image forming section based on the target density-compliant sheet profile, receiving a density detection result of the other density patch, and adjusting the image forming section such that a highest density with the toner coincides with the target density.

14. The image formation control method according to claim 13, wherein two kinds of density adjustment including a highest density initial adjustment and a highest density automatic adjustment are performed, and wherein in the highest density initial adjustment, the target density is determined to make the highest density coincide with the target density, and in the highest density automatic adjustment, at an arbitrary time after having determined the target density in the highest density initial adjustment, the highest density of the other density patch is detected, and the image forming section is adjusted so as to make the highest density coincide with the target density.

15. The image formation control method according to claim 13, wherein the sheet setting in the target density-compliant sheet profile includes at least a kind of a sheet, a basis weight of the sheet, an offset value of a toner adhesion amount, and information on process adjustment.

16. The image formation control method according to claim 13, wherein the target density-compliant sheet profile is memorized in a predetermined memory position in the memory section, and at the time of adjusting the highest density, the target density is read out from the memory section, and the target density-compliant sheet profile is read out.

17. The image formation control method according to claim 13, wherein the image forming apparatus further comprises a sheet feeding section provided with a tray for accommodating sheets, wherein the target density-compliant sheet profile is correlated with the tray in response to setting of the tray, and at the time of adjusting the highest density, the target density-compliant sheet profile is used without being correlated with the tray.

* * * * *